United States Patent [19]

Ogasawara et al.

[11] Patent Number: 4,993,353

[45] Date of Patent: Feb. 19, 1991

[54] AUTOMATIC COLOR CHANGE PAINT SPRAY SYSTEM

[75] Inventors: Toshifumi Ogasawara, Kure; Yuichi Okada, Higashihiroshima, both of Japan

[73] Assignee: Mazda Motor Corporation, Hiroshima, Japan

[21] Appl. No.: 233,505

[22] Filed: Aug. 18, 1988

[30] Foreign Application Priority Data

Aug. 18, 1987 [JP] Japan ..... 62-204338

[51] Int. Cl.[5] ..... B05C 5/00

[52] U.S. Cl. ..... 118/302; 239/112

[58] Field of Search ..... 118/313-315, 118/326, 621, 629-633, 302, 688, 698, 692, DIG. 4, 677, 629, 300, 302; 239/112, 113, 305, 307

[56] References Cited

U.S. PATENT DOCUMENTS

| | | | |
|---|---|---|---|
| Re. 32,151 | 5/1986 | Scharfenberger | 118/692 |
| 3,219,276 | 11/1965 | Norris | 118/315 |
| 3,348,774 | 10/1967 | Wiggins | 118/302 |
| 3,477,870 | 11/1969 | Boretti et al. | 118/302 |
| 3,672,570 | 6/1972 | Scarborough et al. | 239/112 |
| 3,674,205 | 7/1972 | Kock | 239/112 |
| 4,232,055 | 11/1980 | Shaffer | 239/305 |
| 4,676,189 | 6/1987 | Takeuchi et al. | 118/DIG. 7 |
| 4,714,179 | 12/1987 | Otterstetter et al. | 118/302 |
| 4,771,729 | 9/1988 | Planert et al. | 118/629 |

*Primary Examiner*—Willard E. Hoag

*Attorney, Agent, or Firm*—Fleit, Jacobson, Cohn, Price, Holman & Stern

[57] ABSTRACT

An automatic color change paint spray system for vehicles moving along a production line which includes a paint spray device for painting. A first color change manifold is provided for supplying paint to the paint spray device. A paint feed tube connects the first color change manifold with the paint spray device. A second color change manifold is connected into the paint feed tube between the first color change manifold and the paint spray device, near the paint spray device.

10 Claims, 4 Drawing Sheets

AUTOMATIC COLOR CHANGE PAINT SPRAY SYSTEM

FIELD OF THE INVENTION

This invention relates to an improved spray painting system capable of automatically painting with different colored paints successive workpieces such as vehicle bodies moving on a mass production line.

BACKGROUND OF THE INVENTION

Conventionally, an automatic color change paint spray system for vehicle bodies moving on a mass production line is generally composed of a spray nozzle or gun mounted on a travelling carriage and a plurality of color change valves mounted near the carriage connected to sources of paint by suitable hoses. The distance from the valves to the spray nozzle is about 4 to 5 meters. The valves are connected with the spray nozzle by a common manifold and a single hose. A thinner and air supplying valve unit is associated with the valves such that cleaning for a color change is carried out by cleaning the manifold and single hose connecting the manifold with the spray nozzle first by flushing with thinner or solvent and then drying with air. The automatic color change paint spray system is controlled by orders from a control unit. In use, the automatic color change paint spray system supplies a selected colored paint to the paint spray nozzle or gun by way of the single paint feed tube leading from the manifold to the spray gun. Japanese Patent Publication (Tokkosho) No. 59-50389 and other prior art discloses examples of such systems.

Although this known prior art system is generally satisfactory, its main drawback is that the distance from the paint color change valves to the spray gun is relatively long and due to the large number of paint colors for the vehicle painting that are presently required, diversification and the public's desire for more available colors, color change of successive vehicle bodies on the production line is more likely. Therefore, cleaning of the system for a color change occurs more frequently resulting in loss of paint and use of more solvent, air and power all of which result in a concomitant increase in cost.

SUMMARY OF THE INVENTION

The present invention seeks to overcome this drawback in the art by providing an improved color change paint spray system which in part simplifies the cleaning of the paint feed line and spray gun and, therefore, decreases the cost of painting. This is accomplished by the present invention through use of an automatic color change paint spray system in which some of the color change valves are mounted in proximity with the spray gun via a second manifold and are, therefore, connected to the spray gun through a relatively short (about 0.7 m) feed line. The first color manifold is connected by a feed line (about 2–3 m) to the second color manifold. The spray gun is mounted on the end of a horizontal boom or arm which is cantilever supported by a vertical strut fixed onto a reciprocating carriage that reciprocates parallel to the production line. The second manifold is mounted directly onto the boom or arm in close proximity to the spray gun. Since the boom is cantilever supported by the strut there is a weight limitation and only a few, two to four, color change valves, and a cleaner valve can be supported by the boom in close proximity to the spray gun. Accordingly, when it is possible to use a color of the second color change manifold, the cleaning of the paint feed tube is required only between the second color change manifold and the paint spray gun, resulting in a reduction in the amount of paint lost and a savings of solvent, air and power.

BRIEF DESCRIPTION OF THE DRAWINGS

Further objects and features of the present invention will become apparent from the following description of the preferred embodiment taken in conjunction with the accompanying drawings, in which, like parts are designated by like reference numerals, and in which.

DETAILED DESCRIPTION OF THE PREFERRED EMBODIMENT

Figure 3:
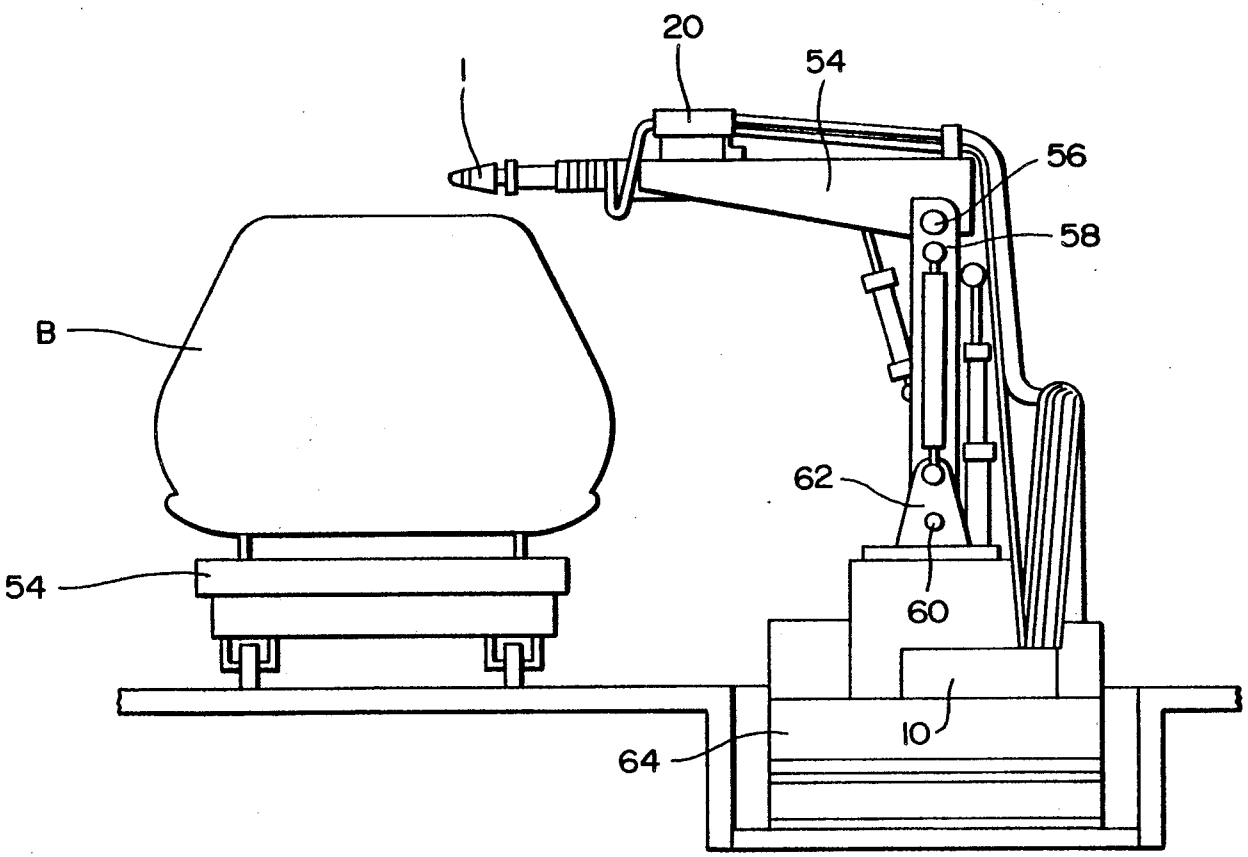
FIG. 3 is a side elevation showing a vehicle moving on a production line and the novel paint spray system of the present invention.
Figure 4:
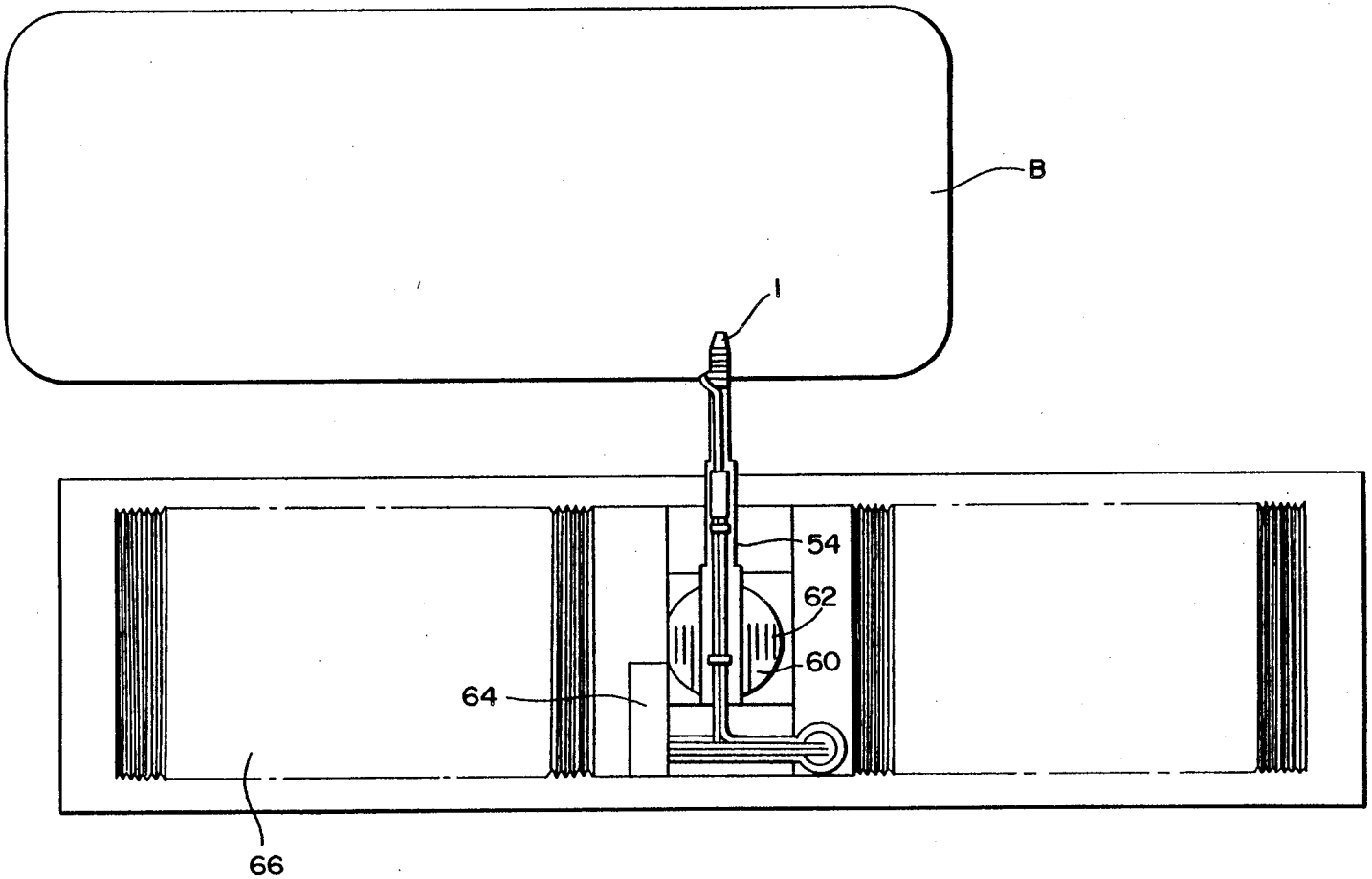
FIG. 4 is a top plan view of what is portrayed in FIG. 3.

Referring now to the drawings, FIGS. 3 and 4 show the inventive automatic color change paint spray apparatus in the context of a vehicle mass production line. As shown, a vehicle body B to be painted is carried on a truck 52 along a production line in a known and conventional manner. As it passes a paint station, a spray gun 1 paints a portion of the vehicle body. Similar spray guns in known manner paint other portions of the vehicle body as it passes along the production line.

As is known in the art, spray gun 1 is mounted on the free end of an extensible boom 54 which is pivotally mounted at 56 at its other end to a vertical strut 58 which, in turn, is pivotally mounted at 60 to a base 62 mounted on a carriage 64. Slide guides are provided for carriage 64 so it moves back and forth parallel to the production line. Hydraulic piston and cylinder assemblies 66 enable the spray gun 1 to be universally positioned relative to the vehicle body B. A bellows 66 on both sides of carriage 64 protects the underlying mechanism and structure from becoming fouled with paint.

Figure 1:
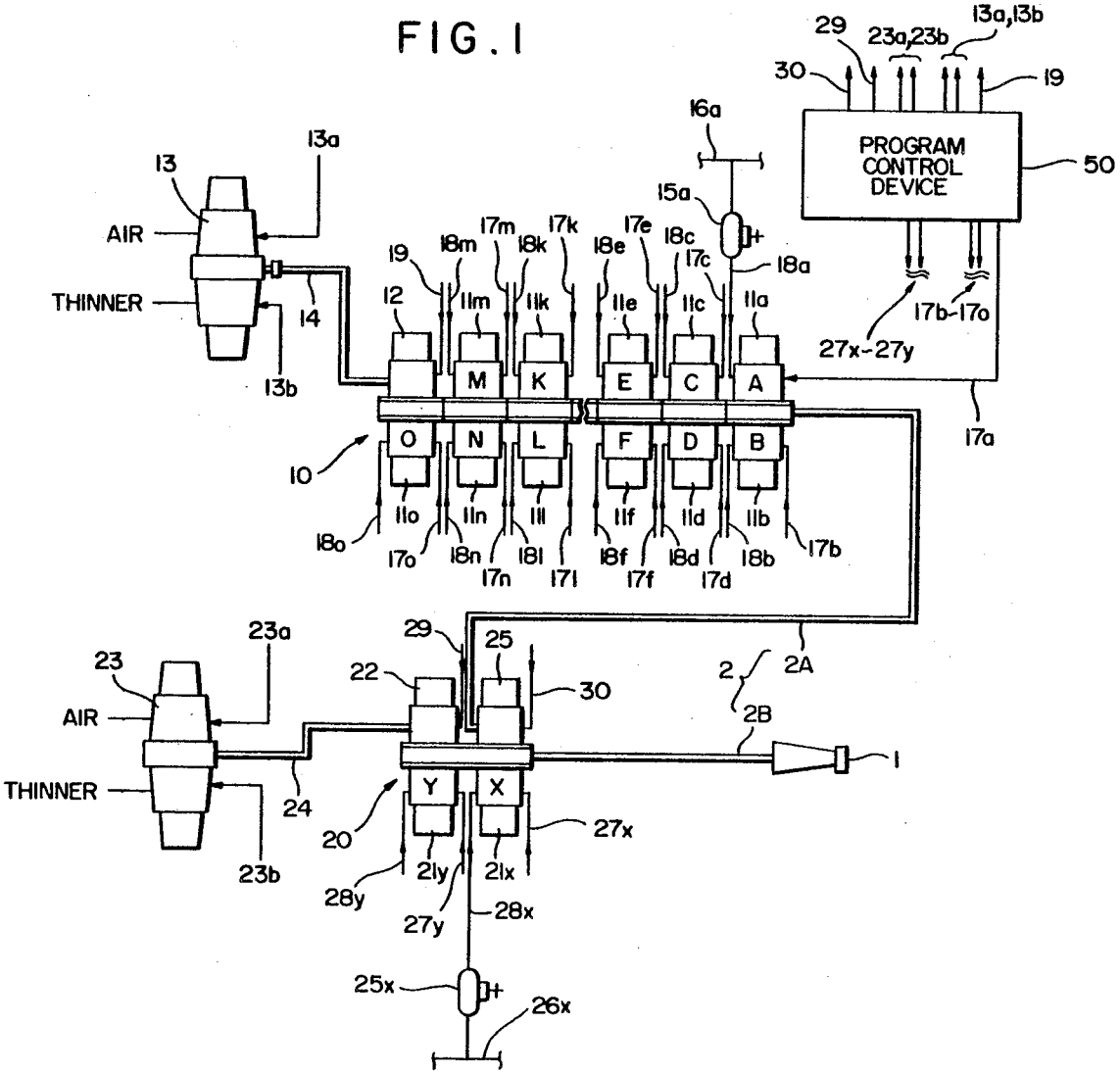
FIG. 1 is a partly block and partly schematic diagram of the novel automatic color change paint spray system of the present invention showing how any one of a plurality of different paints can be dispensed and sprayed.

Referring now to FIG. 1, the inventive automatic color change paint spray apparatus is illustrated according to one preferred embodiment of the present invention. The automatic color change paint spray apparatus has a first color change manifold 10 capable of changing one of a plurality of paints A–O for another. Paint spray gun 1 is connected by a single paint feed tube 2 to the manifold 10. A second color change manifold 20 is provided capable of changing from color paint X to color paint Y. The second color change manifold 20 is connected into the paint feed tube 2 so that tube section 2B lies between the gun 1 and the second manifold 20 and tube section 2A interconnects manifolds 10, 20.

The first color change manifold 10 has color paints A–O (or more) each of which is a standard color paint. The second color change manifold 20 has color paints X, Y (or more) which form special color paints. The frequency of use of the special color paints is lower than the frequency of use of the standard color paints, but may be higher.

A color change valve 11*a* of the first color change manifold 10 is connected with a color paint A storage tank (not shown) by way of paint feed tubes 18*a* and 16*a*. The paint feed tube 18*a* includes a valve 15*a* (relief valve) for controlling the pressure of paint A as it is fed.

In the same manner, respective color change valves 11*b*–11*o* are connected with respective color paints B–O storage tanks (not shown) by way of respective paint feed tubes 18*b*–18*o*, each including a relief valve and a feed tube 16*b*–16*o*. Furthermore, the first color change manifold 10 has a most upstream valve 12 for admitting solvent into the single paint feed tube 2 and common conduit of the manifold 10. The valve 12 is connected by way of a connecting tube 14 with a changing valve 13 for selectively changing between solvent or thinner and air. The arrangement of the manifold 10 is generally known in the art. Manifold 10, including associated valves 11*a*–11*o* and 13, is mounted on carriage 64 as indicated.

A color change valve 21X of the second color change manifold 20 is connected with a color paint X storage tank (not shown) by way of paint feed tubes 28X and 26X. The paint feed tube 28X includes a valve 25X for controlling the feeding pressure of paint X. In the same manner, color change valve 21Y is connected with a color paint Y storage tank (not shown) by way of paint feed tube 28Y, etc. Furthermore, the second color change manifold 20 has a most upstream valve 22 for admitting solvent or thinner for washing into or cleaning single paint feed tube 2B and the common conduit of the manifold 20, and has an opening and shutting valve 25 for opening or shutting paint feed tube 2A to or from the paint feed tube 2B. The valve 22 is connected by way of a connecting tube 24 with a changing valve 23 for selectively changing between solvent or thinner and air.

The color change valve 11*a* of the manifold 10 is connected with a program control device 50 by way of a line 17*a*. In the same manner, the color change valves 11*b*–11*o* are connected with the program control device 50 by way of lines 17*b*–17*o*, and the valves 12 and 13 are connected with the program control device 50 by way of lines 19, 13*a* and 13*b*.

The color change valve 21X of the manifold 20 is connected with program control device 50 by way of a line 27X. In the same manner, the color change valve 21Y and valves 22, 23, and 25 are connected with the program control device 50 by way of lines 29, 23*a*, 23*b* and 30. Therefore, the opening and shutting operation of the aforementioned valves are controlled by instructions of the program control device 50 based on vehicle body transfer order. This general arrangement and control is known in the art and conventional and need not be explained in detail herein because it is known and understood by those skilled in the art.

Functioning of the inventive automatic color change paint spray apparatus for use on a vehicle body painting line, as described so far, will now be explained. For example, when a vehicle body is painted by the use of the paint A of the first color change manifold 10, the program control device 50 provides an opening signal to respective color change valve 11*a* and valve 25. Therefore, the valve 11*a* provides the paint A to the gun 1, by way of the paint feed tube 2. Accordingly, the vehicle body is painted by spraying paint A from the gun 1. In case the next painting color required for the succeeding vehicle body is one of the second color change manifold 20 after the paint A spray is finished, for example, the next paint is the paint X, the program control device 50 provides a shutting signal to the valves 11*a* and 25, and an opening signal to the valve 22 by way of lines 17*a* and 30. Thereafter, the program control device 50 after a short delay provides mutually an opening signal and a shutting signal to the changing valve 23 by way of the lines 23*a* and 23*b*. Therefore, the common conduit of the manifold 20 and paint feed tube 2B are washed away or cleaned by thinner and air from the valve 23. After the valve 23 provides successively thinner and air for a predetermined number of times to the manifold 20 and paint feed tube 2B, the program control device 50 provides a shutting signal to the valves 22 an 23, and an opening signal to the color change valve 21X by way of the line 27X. Therefore,, the valve 21X provides the paint X to the gun 1, by way of the paint feed tube 2B and a vehicle body is painted by spraying paint X from the gun 1.

Accordingly, in case of paint changing from one of the first color change manifold 10 to one of the second color change manifold 20, or paint changing from one of the second manifold 20 to the other one of the second manifold 20, the conduit of the manifold 20 and paint feed tube 2B only are washed away or cleaned by the use of thinner and air from the valve 23. Therefore, the amount of the paint loss is decreased and lower amounts of solvent, air and power are required. Furthermore, in case of paint changing from one of the second color change manifold 20 to one of the first color change manifold 10, if the selected paint of the first color change manifold 10 is the same as previously used in the manifold 10 the last time, the conduit of the manifold 20 and paint feed tube 2B only need to be cleaned and dried. In case of paint changing from one color of the first color change manifold 10 to another color of the first color change manifold 10, the conduit of the first color change manifold 10, the paint feed tube 2 and the gun 1 are all cleaned and dried by the use of thinner and air from the valve 13.

In case of the color change paint spray apparatus having a plurality of paints of the same color but to be used on different components, the plurality of paints may be divided between the first color change manifold 10 and the second color change manifold 20 based on the difference of the components. Furthermore, in case the number of the paints is only a few, it is possible to switch paints of the first color change manifold 10 to paints of the second color change manifold 20.

Figure 2:
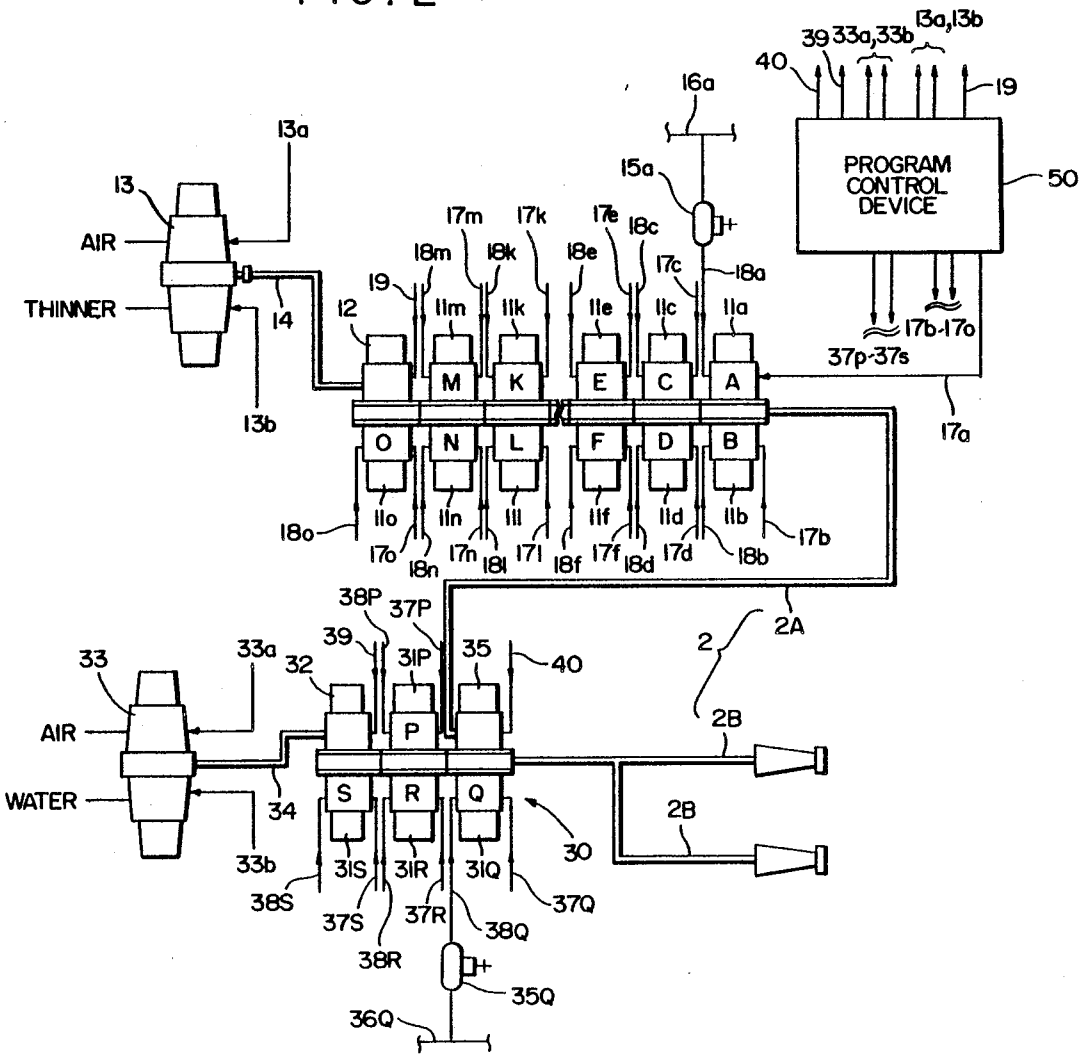
FIG. 2 is a view similar to FIG. 1, showing a modification thereof.

FIG. 2 illustrates a modification of the present invention. The automatic color change paint spray apparatus has a first color change manifold 10 capable of changing or selecting one of paints A–O and fluid for washing away or cleaning selectively, a paint spray gun 1, a paint feed tube 2 connecting the gun 1 to the manifold 10, and a second color change manifold 30 capable of changing or selecting one of paints P–S and fluid for wash away or cleaning selectively. The paint A–O of the first color change manifold 10 are oil base paints; the paints P–S of the second color change manifold 30 are water base paints. A color change valve 31Q of the second color change manifold 30 is connected with a water base paint Q storage tank (not shown) by way of paint feed tubes 38Q and 36Q. The paint feed tube 38Q includes a valve 35Q (relief valve) for controlling feeding pressure of paint Q. In the same manner, respective color change valves 31P, 31R and 31S are connected with respective water base points P, R and S storage tanks (not shown) by way of paint feed tubes 38P, 38R and 38S including relief valves. Furthermore, the second color change manifold 30 has a most upstream valve 32 for washing into or cleaning two branched paint feed tubes 2B, 2B and common conduit for the manifold 30, and has an opening and shutting valve 35 for opening or shutting paint feed tube 2A to the branched paint feed tubes 2B, 2B. Valve 32 is connected with a changing valve 33 for mutual exchanging between water and air, by way of a connecting tube 34.

The color change valve 31Q of the manifold 30 is connected with program control device 50 by way of a line 37Q. In the same manner, the color change valves 31P, 31R and 31S and valves 32, 33 and 35 are connected with the program control device 50 by way of lines 37P, 37R, 37S, 39, **33*a*, 33*b* and 40**.

Therefore, and as known in the art, the opening and shutting operation of the aforementioned valves and the valves 12, 13 and the color change valves **11*a*–11*o* of the first color change manifold 10 are controlled by instructions of the program control device 50 based on vehicle body transfer order. Accordingly, in case of paint changing from one of the first color change manifold 10 to one of the second color change manifold 30, or paint changing from one of the second color change manifold 30 to the other of the second manifold 30, the conduit of the manifold 30 and branched paint feed tubes 2B, 2B only are washed away or cleaned and dried by the use of water and air from the valve 33. Therefore, the amount of the paint washed away or lost is decreased. Further, the amount of water and air used to wash away the water base paint and dry tubes 2B, 2B** is minimized.

Although the present invention has been fully described by way of preferred embodiments, it is to be noted that various changes and modifications will be apparent to those skilled in the art. Such changes and modifications are deemed to fall within the purview of the present invention.

What is claimed is:

1. An automatic color change paint spray apparatus for painting vehicle bodies passing along a production line comprising a carriage located adjacent to the production line;

said carriage including a vertical portion and a boom portion extending from the vertical portion to adjacent to the vehicle bodies passing along the production line;

a paint sprayer mounted on the boom portion;

first color change manifold means for supplying any one of a plurality of paints selectively to the paint sprayer and including cleaning and drying means for cleaning and drying the first color change manifold means during a paint change;

conduit means connecting the first color change manifold means to the paint sprayer;

second color change manifold means for supplying any one of a plurality of paints selectively to the paint sprayer;

the second color change manifold means being interposed in the conduit means and located on the boom portion in proximity to the paint sprayer such that a distance between the second color change manifold means and the paint sprayer is shorter than a distance between the first color change manifold means and the paint sprayer and a number of paint sources available from the second color change manifold means being less than a number of paint sources available from the first color change manifold means;

the second color change manifold means including cleaning and drying means for cleaning and drying the second color change manifold means, the paint sprayer and that portion of the conduit means extending from the second manifold means to the paint sprayer, and the second color change manifold means including at least one paint different from those of the first color change manifold means.

2. An automatic color change paint spray apparatus as claimed in claim 1, wherein said first color change manifold means has a plurality of switching valve means each of which is provided to correspond with one of a first group of paints, and said second color change manifold means has an another plurality of switching valve means each of which is provided to correspond with one of a second group of paints, said second group of paints being used less frequently than said first group of paints for painting the vehicle bodies.

3. An automatic color change paint spray apparatus as claimed in claim 1, wherein the first color change manifold means has a plurality of switching valve means each of which is provided to correspond with one of a first group of paints, and the second color change manifold has an another plurality of switching valve means each of which is provided to correspond with one of a second group of paints, said second group of paints being used more frequently than said first group of paints for painting the vehicle bodies.

4. An automatic color change paint spray apparatus as claimed in claim 1, wherein said first color change manifold means includes means for supplying oil paints and said second color change manifold means includes means for supplying water base paints.

5. An automatic color change paint spray apparatus as claimed in claim 4, wherein the cleaning and drying means includes a fluid switching valve means for alternately supplying solvent for cleaning oil or water base paints in the color change manifold means and air for drying the color change manifold means.

6. An automatic color change paint spray apparatus as claimed in claim 1, wherein said conduit means comprises a first paint feed tube connecting said first color change manifold means with said second color change manifold means and a second paint feed tube connecting said second color change manifold means with the paint sprayer, said second color change manifold means including valve means for communicating the first paint feed tube and the second paint feed tube.

7. An automatic color change paint spray apparatus as claimed in claim 6, wherein said valve means is located in the most downstream position of said second color change manifold means.

8. An automatic color change paint spray apparatus as claimed in claim 6, wherein the cleaning and drying means of the second color change manifold means is located in the most upstream position in the second color change manifold means.

9. An automatic color change paint spray apparatus as claimed in claim 6, wherein said first paint feed tube is a single paint feed tube and said second paint feed tube is branched and said paint sprayer is mounted on the end of one of the branches of the second paint feed tube and a second paint sprayer is mounted on the end of another of the branches of the second paint feed tube.

10. An automatic color change paint spray apparatus for painting vehicle bodies passing along a production line comprising a carriage located adjacent to the production line;

said carriage including a vertical portion and a boom portion extending from the vertical portion to adjacent to the vehicle bodies passing along the production line;

a paint sprayer mounted on the boom portion;

first color change manifold means for supplying any one of a plurality of paints selectively to the paint sprayer and including cleaning and drying means for cleaning and drying the first color change manifold means during a paint change;

second color change manifold means for supplying any one of a plurality of paints selectively to the paint sprayer;

the second color change manifold means being located on the boom portion and including cleaning and drying means for cleaning and drying the second color change manifold means and the paint sprayer;

conduit means for connecting the first color change manifold means and the second color change manifold means to the paint sprayer;

the conduit means being provided such that a distance between the second color change manifold means and the paint sprayer is shorter than a distance between the first color change manifold means and the paint sprayer; and the second color change manifold means including at least one paint different from those of the first color change manifold means.

* * * * *